US008910409B1

(12) United States Patent
Fonte

(10) Patent No.: US 8,910,409 B1
(45) Date of Patent: Dec. 16, 2014

(54) SYSTEM AND METHOD OF PRODUCING AUTOFRETTAGE IN TUBULAR COMPONENTS USING A FLOWFORMING PROCESS

(75) Inventor: Matthew V. Fonte, Charlestown, MA (US)

(73) Assignee: ATI Properties, Inc., Albany, OR (US)

( * ) Notice: Subject to any disclaimer, the term of this patent is extended or adjusted under 35 U.S.C. 154(b) by 840 days.

(21) Appl. No.: 13/023,189

(22) Filed: Feb. 8, 2011

Related U.S. Application Data

(60) Provisional application No. 61/302,778, filed on Feb. 9, 2010.

(51) Int. Cl.
*C21D 8/10* (2006.01)
*F41C 27/00* (2006.01)

(52) U.S. Cl.
USPC ..... 42/76.1; 148/519; 72/67; 89/14.7

(58) Field of Classification Search
USPC ..... 148/519, 590, 592, 593, 594, 325, 327, 148/426–429, 425, 442, 909; 89/14.7, 14.8, 89/14.05; 42/76.01, 76.1, 76.02; 72/67–126
See application file for complete search history.

(56) References Cited

U.S. PATENT DOCUMENTS

| | | | | |
|---|---|---|---|---|
| 1,346,188 | A | 7/1920 | Fahrenwald | |
| 1,365,987 | A | 1/1921 | Hadfield et al. | |
| 1,384,718 | A | 7/1921 | Guy | |
| 1,553,825 | A | 9/1925 | Langenberg | |
| 1,602,282 | A * | 10/1926 | Methlin | 89/14.7 |
| 2,104,319 | A | 1/1938 | Dicke | |
| 2,541,114 | A | 2/1951 | Somes | |
| 2,541,116 | A | 2/1951 | Somes | |
| 2,876,095 | A | 3/1959 | Dickerson | |
| 2,990,342 | A | 6/1961 | Sullivan | |
| 3,017,793 | A | 1/1962 | Appel | |
| 3,091,022 | A | 5/1963 | Faulkner | |
| 3,516,326 | A | 6/1970 | Donner | |
| 3,571,962 | A | 3/1971 | Eig | |
| 3,626,570 | A * | 12/1971 | Kushnir et al. | 75/246 |
| 3,660,177 | A | 5/1972 | Brown et al. | |

(Continued)

FOREIGN PATENT DOCUMENTS

| | | | | |
|---|---|---|---|---|
| EP | 614712 A1 * | 9/1994 | | B21H 7/18 |
| JP | 01130822 A * | 5/1989 | | B21D 22/16 |

OTHER PUBLICATIONS

"White Paper Autofrettage," Maximator Test, LLC, 4 pages.

(Continued)

*Primary Examiner* — Benjamin P Lee
(74) *Attorney, Agent, or Firm* — John E. Grosselin, III; K&L Gates LLP

(57) ABSTRACT

A method of producing autofrettage in a tubular component provides a tubular workpiece having an inner diameter and an outer diameter and provides at least two rollers having a displacement from one another in an axial direction with respect to the workpiece. The method places the workpiece on a mandrel such that the inner diameter is adjacent to the mandrel. The method also compresses the outer diameter of the workpiece with the rollers at a temperature below a recrystallization temperature of the workpiece using a combination of axial and radial forces so that the mandrel contacts the inner diameter and imparts a compressive hoop stress to the inner diameter of the workpiece.

17 Claims, 9 Drawing Sheets

(56) References Cited

U.S. PATENT DOCUMENTS

| | | | | |
|---|---|---|---|---|
| 4,359,352 | A | 11/1982 | Ray et al. | |
| 4,409,881 | A | 10/1983 | van der Wielen | |
| 4,411,569 | A | 10/1983 | Pizzola | |
| 4,417,459 | A | 11/1983 | Tomita | |
| 4,571,969 | A | 2/1986 | Tomita | |
| 4,622,080 | A | 11/1986 | Wegwerth | |
| 4,669,212 | A | 6/1987 | Jackson et al. | |
| 4,747,225 | A | 5/1988 | Gstettner et al. | |
| 4,756,677 | A | 7/1988 | Hribernik et al. | |
| 4,911,060 | A | 3/1990 | Greenspan et al. | |
| 5,004,529 | A | 4/1991 | Vishnitsky | |
| 5,154,780 | A | 10/1992 | Premkumar | |
| 5,160,802 | A * | 11/1992 | Moscrip | 89/16 |
| 5,341,719 | A | 8/1994 | Bullis et al. | |
| 5,344,508 | A | 9/1994 | Gilman et al. | |
| 5,470,373 | A | 11/1995 | Edelstein et al. | |
| 5,649,440 | A * | 7/1997 | Arnautu et al. | 72/96 |
| 5,856,631 | A | 1/1999 | Julien | |
| 5,928,799 | A | 7/1999 | Sherman et al. | |
| 5,935,351 | A | 8/1999 | Sherman et al. | |
| 6,038,901 | A * | 3/2000 | Stein et al. | 72/85 |
| 6,068,814 | A | 5/2000 | Kang et al. | |
| 6,298,764 | B1 | 10/2001 | Sherman et al. | |
| 6,422,010 | B1 * | 7/2002 | Julien | 60/527 |
| 6,523,385 | B2 * | 2/2003 | Hausler | 72/85 |
| 6,564,689 | B1 | 5/2003 | Billgren | |
| 6,594,936 | B1 | 7/2003 | Sniezak et al. | |
| 6,615,702 | B1 | 9/2003 | Julien | |
| 6,810,615 | B2 | 11/2004 | Hermanson et al. | |
| 6,880,220 | B2 * | 4/2005 | Gandy | 29/407.01 |
| 6,908,516 | B2 | 6/2005 | Hehmann et al. | |
| 6,923,900 | B2 | 8/2005 | Jones et al. | |
| 6,931,776 | B2 * | 8/2005 | Wagner et al. | 42/76.1 |
| 7,482,065 | B2 | 1/2009 | Branagan | |
| 7,520,947 | B2 | 4/2009 | Kennedy et al. | |
| 7,721,478 | B2 | 5/2010 | Withers et al. | |
| 7,818,986 | B1 * | 10/2010 | Parker et al. | 72/58 |
| 7,921,590 | B2 | 4/2011 | Briggs et al. | |
| 7,934,332 | B2 * | 5/2011 | Briggs | 42/76.02 |
| 7,963,202 | B1 | 6/2011 | Becker et al. | |
| 8,075,839 | B2 | 12/2011 | Srivastava | |
| 8,302,341 | B2 * | 11/2012 | Fonte | 42/76.1 |
| 8,388,890 | B2 | 3/2013 | Hilty et al. | |
| 8,479,549 | B1 * | 7/2013 | Fonte | 72/84 |
| 8,671,609 | B2 | 3/2014 | Fonte | |
| 2003/0019269 | A1 * | 1/2003 | Rolf | 72/85 |
| 2004/0148839 | A1 * | 8/2004 | Hermanson et al. | 42/76.1 |
| 2005/0066801 | A1 | 3/2005 | Hermanson et al. | |
| 2005/0076975 | A1 * | 4/2005 | Lopez et al. | 148/593 |
| 2005/0194073 | A1 | 9/2005 | Hamano et al. | |
| 2005/0279630 | A1 | 12/2005 | Fonte | |
| 2006/0070688 | A1 * | 4/2006 | Fonte et al. | 148/670 |
| 2006/0288854 | A1 | 12/2006 | Witherell et al. | |
| 2009/0084255 | A1 * | 4/2009 | Carter et al. | 89/14.7 |
| 2009/0217812 | A1 | 9/2009 | Whitaker et al. | |
| 2010/0236122 | A1 * | 9/2010 | Fonte | 42/76.1 |
| 2011/0011253 | A1 * | 1/2011 | Fonte | 89/14.05 |

OTHER PUBLICATIONS

Drennen et al., "Rotary Swaged Rapid-Fire Gun Barrels," Battelle Memorial Institute, 100 pages, Aug. 1972.

Tillack et al., "Heat Treating of Nickel Alloys," adapted from Heat Treating, ASM Handbook, ASM International, vol. 4, pp. 907-912, 1990.

Prevey, "The Effect of Cold Work on the Thermal Stability of Residual Compression in Surface Enhanced IN718," Lambda Technologies, 20th ASM Materials Solutions Conference & Exposition, 9 pages, Oct. 10-12, 2000.

Parker et al., "Residual Stresses and Lifetimes of Tubes Subjected to Shrink Fit Prior to Autofrettage," ASME, vol. 125, pp. 282-286, Aug. 2003.

Burton et al., "Army Materials Research: Transforming Land Combat Through New Technologies," AMPTIAC Quarterly, vol. 8, No. 4, 10 pages, 2004.

Frank, "Selection of Age-Hardenable Superalloys," 13 pages, Jun. 2005.

Cammett et al., "The Effect of Shot Peening Coverage on Residual Stress, Cold Work, and Fatigue in a Nickel-Base Superalloy," Lambda Technologies, Proceedings of ICSP 9, pp. 1-6, Sep. 6-9, 2005.

Perry et al., "The Influence of the Bauschinger Effect on the Yield Stress, Young's Modulus, and Poisson's Ratio of a Gun Barrel Steel," Journal of Pressure Vessel Technology, vol. 128, pp. 179-184, May 2006.

Andrews et al., "Hydraulic Testing of Ordnance Components," ASME, vol. 128, pp. 162-167, May 2006.

Alegre et al., "Fatigue design of wire-wound pressure vessels using ASME-API 579 procedure," Eng Fail Anal, pp. 1-12, 2009.

Lui et al., "Study of Residual Stresses in the Barrel Processed by the Radial Forging," 2009 Second International Conference on Information and Computing Science, IEEE Computer Society, pp. 131-134, 2009.

Aguayo et al., "Elastic Stability and Electronic Structure of fcc Ti, Zr, and Hf: A First-principles Study," Physical Review B, vol. 65, 092106, 4 pages, Feb. 2002.

Del Corso, "Effect of Cold Drawing & Heat Treating on Powder Metallurgy Processed ASTM F 1537 Alloy 1 & Alloy 2 Barstock," Carpenter Technology Corporation, Reading, PA, 6 pages, 2003.

Gloaguen et al., "Measurement and Prediction of Residual Stresses and Crystallographic Texture Development in Rolled Zircaloy-4 Plates: X-ray Diffraction and the Self-Consistent Model," Acta Materialia, vol. 55, pp. 4369-4379, 2007.

Janaki Ram et al., "Microstructure and Wear Properties of LENS@ Deposited medical Grade CoCrMo," J. Mater Sci: Mater Med, vol. 19, pp. 2105-2111, 2008.

Mani Krishna et al, "Microstructural and Textural Developments During Zircaloy-4 Fuel Tube Fabrication," Journal of Nuclear Materials, vol. 383, pp. 78-85, 2008.

Mani-Medrano et al., "Effect of Plastic Deformation on the Isothermal FCC/HCP Phase Transformation During Aging of Co—27Cr—5Mo—0.05C Alloy," Materials Science Forum, vol. 560, pp. 23-28, 2007.

Montero-Ocampo et al., "Effect of Fcc-Hcp Phase Transformation Produced by Isothermal Aging on the Corrosion Resistance of a Co—27CR—5Mo—0.05C Alloy," Metallurgical and Materials Transactions A, vol. 33A, pp. 2229-2235, Jul. 2002.

Opris et al., "Development of Stellite Alloy Composites with Sintering/HIPing Technique for Wear-Resistant Applications," Materials & Design, vol. 28, pp. 581-591, 2007.

Paul et al., "Hot Working Characteristics of Cobalt in the Temperature Range 600-950° C.," Scripta Materialia, vol. 60, pp. 104-107, 2009.

Robertson et al., "Crystallographic Texture for Tube and Plate of the Superelastic/Shape-Memory Alloy Nitinol Used for Endovascular Stents," Wiley InterScience, pp. 190-199, 2004.

Robertson et al., "Effect of Product Form and Heat Treatment on the Crystallographic Texture of Austenitic Nitinol," J. Mater Sci, vol. 41, pp. 621-630, 2006.

Theaker et al., "Development of Crystallographic Texture in CANDU Calandria Tubes," Thirteenth International Symposium, ASTM STP, pp. 445-464, 2002.

Yu et al., "A Comparison of the Tribo-Mechanical Properties of a Wear Resistant Cobalt-Based Alloy Produced by Different Manufacturing Processes," Transactions of the ASME, vol. 129, pp. 586-594, Jul. 2007.

PMF Industries, Understanding Flowforming web archived Oct. 13, 2004 (http://web.archive.org/web/20041013173007/http://www.pmfind.com/Flowforming/Flowforming/Flowforming-6-04.pdf).

McMullen, "Application of Sub-Models to Explore Geometric Effects in Medium Caliber Gun Barrels," Concurrent Technologies Corporation (Date Unknown), 19 pages.

Antunes et al., "Influence of Stress State on High Temperature Fatigue Crack Growth in Inconel 718," Fatigue & Fracture of Engineering Materials & Structures, 24 (2001), pp. 127-135.

Koch et al., "Seamless Thin-Walled TiAl6V4 Tubes Manufactured by Flow-Forming Process," Titanium '92, Science and Technology, The Minerals, Metals & Materials Society (1993), pp. 1429-1436.

(56) References Cited

OTHER PUBLICATIONS

Rifling by Flow Forming: A New Developed Method for Rifling Barrels (http://www.macdor.com/technical_documents/Rifling_by_flow forming.pdf).
Rifling: Facts, Discussion Forum, and Encyclopedia Article (http://www.absoluteastronomy.com/topics/Rifling).
Solicitation/Contract/Order for Commercial Items, Contract No. W15QKN-04-M-0184, Award/Effective Date: Apr. 23, 2004, 2 pages.
Amendment of Solicitation/Modification of Contract, Amendment/Modification No. W15QKN-04-M-0184, Effective Date: Jul. 29, 2004, 3 pages.
Solicitation/Contract/Order for Commercial Items, Contract No. W15QKN-05-P-0123, Award/Effective Date: Mar. 10, 2005, 11 pages.
Solicitation/Contract/Order for Commercial Items, Contract No. W15QKN-05-P-0248, Award/Effective Date: Apr. 21, 2005, 10 pages.
Amendment of Solicitation/Modification of Contract, Amendment/Modification No. W15QKN-05-P-0248, Effective Date: Aug. 22, 2005, 2 pages.
Solicitation/Contract/Order for Commercial Items, Contract No. W15QKN-05-P-0312, Award/Effective Date: Jun. 8, 2005, 12 pages.
Amendment of Solicitation/Modification of Contract, Amendment/Modification No. W150KN-05-P-0312, Effective Date: Aug. 23, 2005, 2 pages.
Amendment of Solicitation/Modification of Contract, Amendment/Modification No. W15QKN-05-P-0312, Effective Date: Oct. 25, 2005, 2 pages.
Drawings for Contract No. W15QKN-04-M-0184, Release Date: Jul. 7, 2004, 2 pages.
Drawings for Contract No. W15QKN-04-M-0184, Release Date: Nov. 2, 2004, 2 pages.
DeFries, Richard S., "Hydrostatic Extrusion of 60MM Mortar Tubes," National Technical Information Service, Oct. 1974.
Gourley, Scott R., Mortar Technology, "Special Operations Technology, Online Edition", retrieved from Internet http://www.special-operations-technology.com/article.cfm?DocID=2051, pp. 1-6.
Harlow et al., "Development of an Electrochemical Machining Process for Rifling Lined Gun Barrels," Defense Technical Information Center, Dec. 1972, retrieved from Internet: http://stinet.dtic.mil/oai?&verb=getRecord&metadataPrefix=html&identifier=AS0909379, 1 page.
Kim et al., "Effect of Thermo-Mechanical Treatment on Mechanical Properties and Shape Behavior of Ti-(26-28) at % Nb Alloys", Materials Science and Engineering A, Feb. 6, 2006, pp. 839-843.
Lee et al., "Structure-Property Relationship of Cast Ti—Nb Alloys", Journal of Oral Rehabilitation, Department of Materials Science and Engineering, Blackwell Science Ltd., vol. 29, 2002, pp. 314-322.
Powell, G. W., "Evaluation of Alloys for Use in 81-mm Mortar Tubes; Elevated-Temperature Failures," Failure Analysis and Prevention, vol. 11, ASM Handbook, ASM International, 1986, pp. 263-297.

* cited by examiner

SYSTEM AND METHOD OF PRODUCING AUTOFRETTAGE IN TUBULAR COMPONENTS USING A FLOWFORMING PROCESS

CROSS-REFERENCE TO RELATED APPLICATIONS

The present application claims priority to U.S. Provisional Patent Application No. 61/302,778 filed Feb. 9, 2010, the disclosure of which is incorporated by reference herein in its entirety.

TECHNICAL FIELD

The invention generally relates to tubular components and, more particularly, the invention relates to producing autofrettage in tubular components using compressive metal forming processes.

BACKGROUND ART

There are various industrial uses for cylindrical pressure vessels such as high-pressure pump cylinders and gun barrels. These tubular components are typically subjected to high internal pressure and may be exposed to pressure fluctuations, thermal shock, and a corrosive environment which may all lead to crack initiation and fatigue crack growth on the inner diameter of the component. For example, in a typical cannon gun barrel, the operating conditions may result in a large array of radial cracks developing from the inner surface of the barrel. To increase the maximum allowable pressure in the cannon barrel as well as to reduce its susceptibility to cracking, desired residual stresses may be introduced to the inner diameter of the tubular component, for example, by an autofrettage process.

Autofrettage is a metal fabrication technique used on tubular components to provide increased strength and fatigue life to the tube by creating a compressive residual stress at the bore. During the autofrettage process, a pressure is typically applied within a component resulting in the material at the inner surface undergoing plastic deformation while the material at the outer surface undergoes elastic deformation. The result is that after the pressure is removed, there is a distribution of residual stress, providing a residual compressive stress on the inner surface of the component.

The autofrettage process may be created in a number of ways including explosive, hydraulic or mechanical means. For example, hydraulic autofrettage typically uses high hydrostatic pressure that is applied inside the tube. The tube may be sealed at both ends, the inner diameter filled with fluid, and a pressure applied to the fluid. The pressure applied to the inner diameter of the tube is high enough to plastically deform the bore of the tube but not high enough that it plastically deforms the outer diameter and bursts the tube apart. In mechanical autofrettage, a tube having an inner diameter slightly less than its desired final dimension typically has a slightly oversized die or mandrel pushed through its bore. The dimensions of the initial inner diameter and the mandrel are calculated to strain the material past its elastic limit into plastic deformation so that the final strained diameter is the final desired bore dimension. Once the mandrel is removed, the elastic recovery of the outer portion of the tube puts the now permanently deformed inner portion into compression, providing a residual compressive stress. The magnitude of this residual stress is highly dependent on the amount of material yielding that is induced during this process, which is in turn governed by geometric tolerances and material properties. The compressive residual stresses at the inner diameter of the component induced by the autofrettage process reduce the probability of crack initiation and slow down the growth rate of fatigue cracks, thus prolonging the fatigue life of the tubular component.

These autofrettage processes, however, have some limitations. For example, the stress applied along various parts of the inner diameter are typically uniform and cannot be varied along the length of the tube. In addition, potentially harmful conditions may arise when processing the component. For example, in hydraulic autofrettage, the high pressurized fluids and high pressure seals that are used may fail causing a rapid and uncontrolled release of high-pressure fluid. In mechanical autofrettage, the high pressure equipment used to force the mandrel through the tube or the equipment holding the tube in place may fail causing the rapid and uncontrolled release of the tube and/or mandrel.

SUMMARY OF EMBODIMENTS

In accordance with one embodiment of the invention, a method of producing autofrettage in a tubular component provides a tubular workpiece having an inner diameter and an outer diameter and provides at least two rollers having a displacement from one another in an axial direction with respect to the workpiece. The method places the workpiece on a mandrel such that the inner diameter is adjacent to the mandrel. The method also compresses the outer diameter of the workpiece with the rollers at a temperature below a recrystallization temperature of the workpiece using a combination of axial and radial forces so that the mandrel contacts the inner diameter and imparts a compressive hoop stress to the inner diameter of the workpiece.

In related embodiments, the workpiece may be made of a stainless steel alloy, a titanium-based alloy, a nickel-based superalloy, a cobalt-based superalloy and/or an iron-based superalloy. The method may further include subjecting the workpiece to a precipitation hardening heat treatment after compressing the workpiece. The tubular workpiece may be produced by radial forging (also known as hammer forging), rotary forging and/or rotary swaging (also known as swaging). The method may further include the mandrel imparting a rifling to the inner diameter of the workpiece. Embodiments may include a tubular component produced according to the method.

In accordance with another embodiment of the invention, a flowforming system includes a mandrel configured to hold a tubular workpiece having an inner diameter and an outer diameter and at least two rollers having a displacement from one another in an axial direction with respect to the workpiece. The rollers are configured to contact the outer diameter of the workpiece using a combination of axial and radial forces and to cause the inner diameter of the workpiece to compress against the mandrel.

In accordance with another embodiment of the invention, a method of producing a superalloy tubular component provides a tubular workpiece, made of a superalloy material, having an inner diameter and an outer diameter. The method places the workpiece on a mandrel such that the inner diameter is adjacent to the mandrel and then compresses an outer diameter of the workpiece at a temperature below a recrystallization temperature of the workpiece using a combination of axial and radial forces so that the mandrel contacts the inner diameter and imparts a compressive hoop stress to the inner diameter of the workpiece.

In related embodiments, the superalloy material may include a nickel-based superalloy, a cobalt-based superalloy and/or an iron-based superalloy. The method may further include subjecting the workpiece to a precipitation hardening heat treatment after compressing the workpiece. The tubular workpiece may be produced by rotary forging, radial forging and/or rotary swaging. The method may further include the mandrel imparting a rifling to the inner diameter of the workpiece. Embodiments may include a tubular component produced according to the method.

BRIEF DESCRIPTION OF THE DRAWINGS

The foregoing features of the invention will be more readily understood by reference to the following detailed description, taken with reference to the accompanying drawings, in which.

DESCRIPTION OF ILLUSTRATIVE EMBODIMENTS

Various embodiments of the present invention provide a system and method of producing autofrettage in tubular components using a flowforming process. Embodiments of the process provide a tubular workpiece having an inner and outer diameter and then intentionally staggering the flowform rollers so that the inner diameter of the workpiece sufficiently compresses against a mandrel causing compressive stresses to be imparted to the inner diameter during the final flowform pass. The flowformed workpiece may then undergo an age hardening heat treatment without first undergoing an annealing heat treatment. The precipitation hardening process allows some of the compressive hoop stresses imparted to the inner diameter during the flowforming process to be maintained while increasing the strength of the flowformed workpiece. The compressive hoop stresses on the inner diameter of a tubular component should arrest any crack that may initiate on that surface, effectively improving the fatigue life of the component. Details of illustrative embodiments are discussed below.

Flowforming is a metal forming process used to produce precise, thin wall, cylindrical components. Flowforming is typically performed by compressing the outer diameter of a cylindrical workpiece over an inner, rotating mandrel using a combination of axial, radial and tangential forces from two or more rollers. The material is compressed above its yield strength, causing plastic deformation of the material. As a result, the outer diameter and the wall thickness of the workpiece are decreased, while its length is increased, until the desired geometry of the component is achieved. Flowforming is typically a cold-forming process. Although adiabatic heat is generated from the plastic deformation, the workpiece, mandrel and rollers are typically flooded with a refrigerated coolant to dissipate the heat. This ensures that the material is worked well below its recrystallization temperature. Being a cold-forming process, flowforming increases the material's strength and hardness, textures the material, and often achieves mechanical properties and dimensional accuracies that are far closer to requirements than any warm or hot forming manufacturing process known to the inventor.

Two examples of flowforming methods are forward flowforming and reverse flowforming. Generally, forward flowforming is useful for forming tubes or components having at least one closed or semi-closed end (e.g., a closed cylinder). Reverse flowforming is generally useful for forming tubes or components that have two open ends (e.g., a cylinder having two open ends). In some cases, a combination of forward and reverse flowforming may be utilized to successfully achieve the desired geometry. Typically, forward flowforming and reverse flowforming may be performed on the same flowforming machine by changing the necessary tooling.

Figure 1:
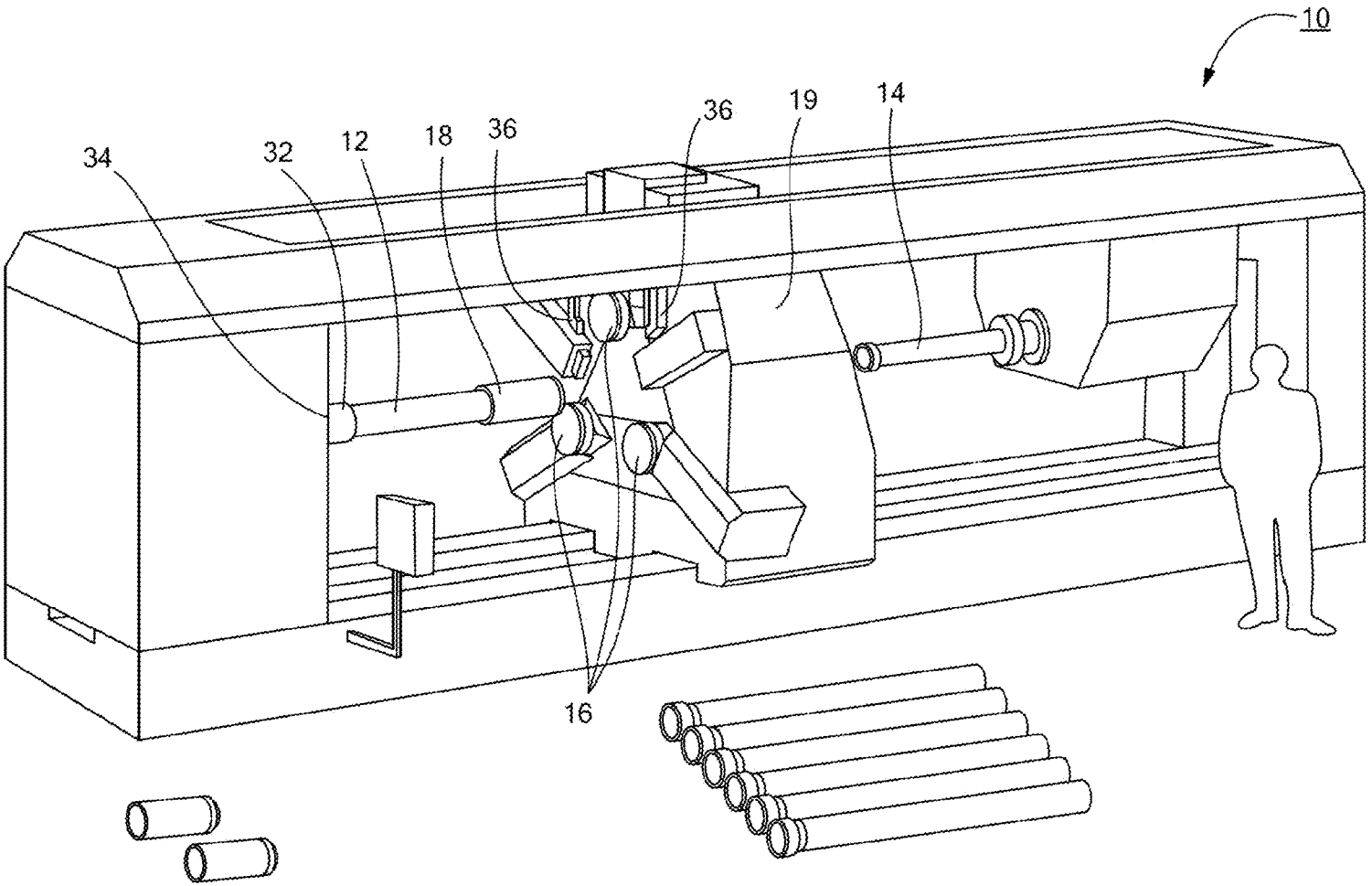
FIG. 1 schematically shows an illustrative flowforming device according to embodiments of the present invention.

FIG. 1 schematically shows an illustrative flowforming device 10 according to some embodiments of the present invention. In this case, the flowforming device 10 is configured for forward flowforming. The flowforming device 10 includes a mandrel 12 for holding a cylindrical workpiece 18, a tailstock 14 that secures the workpiece 18 to the mandrel 12, two or more rollers 16 for applying force to the outer surface of the workpiece 18, and a movable carriage 19 coupled to the rollers 16. As shown in FIG. 1, the rollers 16 may be angularly equidistant from each other relative to the center axis of the workpiece 18, e.g., 120° apart from one another. The rollers 16 may be hydraulically-driven and CNC-controlled. The orientation of the rollers 16 with respect to one another along an axial direction of the workpiece 18 will be described in more detail below.

Figure 2:
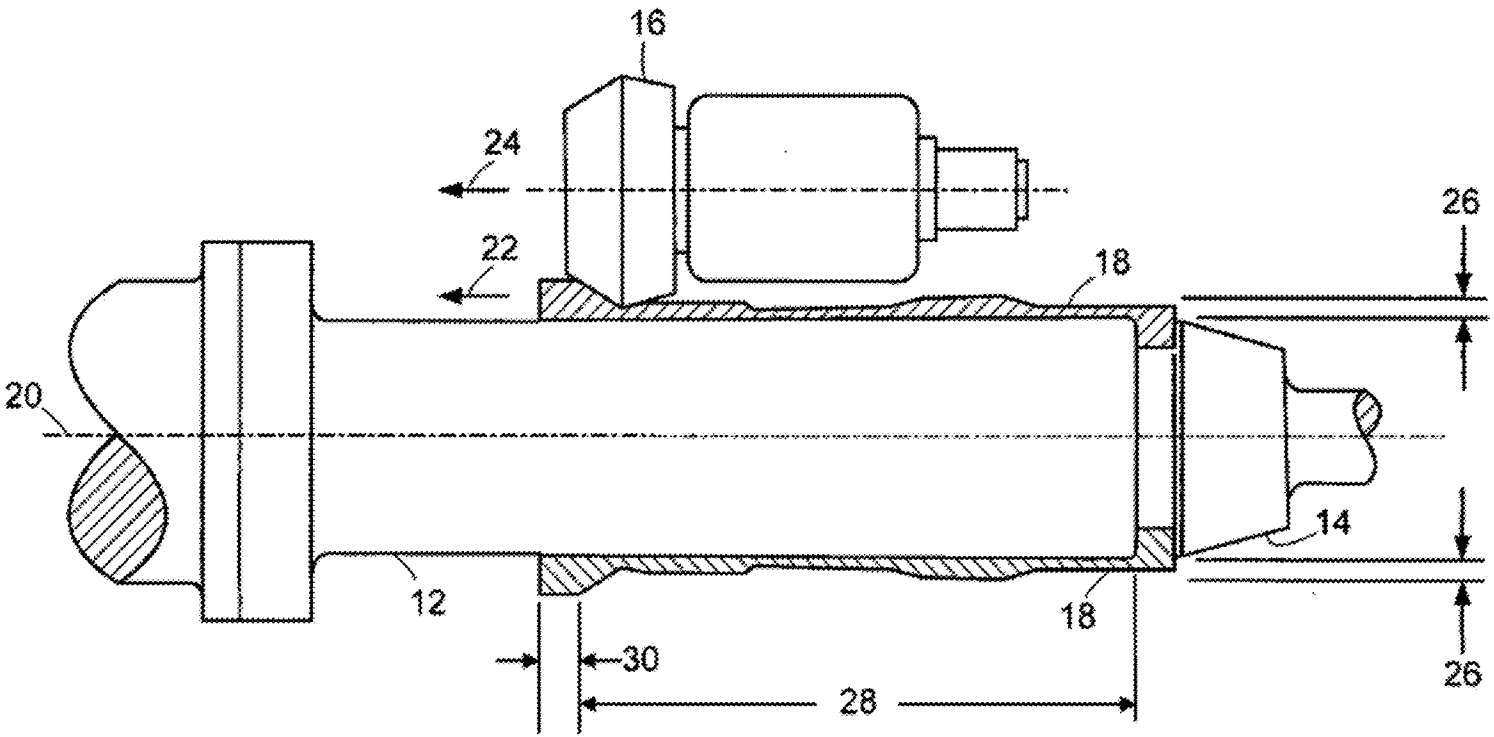
FIG. 2 schematically shows a side-view of a workpiece undergoing a forward flowforming process.

FIG. 2 shows a side-view of a workpiece 18 undergoing a forward flowforming process. During this process, the workpiece 18 may be placed over the mandrel 12 with its closed or semi-closed end toward the end of the mandrel 12 (to the right side of the mandrel, as shown in FIG. 1). The workpiece 18 may be secured against the end of the mandrel 18 by the tailstock 14, e.g., by means of a hydraulic force from the tailstock 14. The mandrel 12 and workpiece 18 may then rotate about an axis 20 while rollers 16 are moved into a position of contact with the outer surface of the workpiece 18 at a desired location along its length. The headstock 34 rotates or drives the mandrel 12 and the tailstock 14 provides additional help to rotate the mandrel 12, so that the long mandrel 12 spins properly.

The carriage 19 may then move the rollers 16 along the workpiece 18 (traveling from right to left, as shown in FIG. 1), generally in direction 24. The rollers 16 may apply one or more forces to the outside surface of the workpiece 18 to reduce its wall thickness 26 and its outer diameter, e.g., using a combination of controlled radial, axial and tangential forces. One or two jets 36 may be used to spray coolant on the rollers 16, workpiece 18 and mandrel 12, although more jets may be used to dissipate the adiabatic heat generated when the workpiece 18 undergoes large amounts of plastic deformation. The mandrel 12 may even be submersed in coolant (not shown), e.g., in a trough type device, so that the coolant collects and pools on the mandrel 12 to keep the workpiece 18 cool.

Rollers 16 may compress the outer surface of the workpiece 18 with enough force that the material is plastically deformed and moves or flows in direction 22, generally parallel to axis 20. Rollers 16 may be positioned at any desired distance from the outer diameter of mandrel 12 or the inner wall of workpiece 18, to produce a wall thickness 26 that may be constant along the length of the workpiece 18 or varied, as shown in FIG. 2. Length 28 represents the portion of the workpiece 18 that has undergone the flowforming process, whereas length 30 is the portion that has yet to be deformed. This process is termed "forward flowforming" because the deformed material flows in the same direction 22 as the direction 24 that the rollers are moving.

Figure 3:
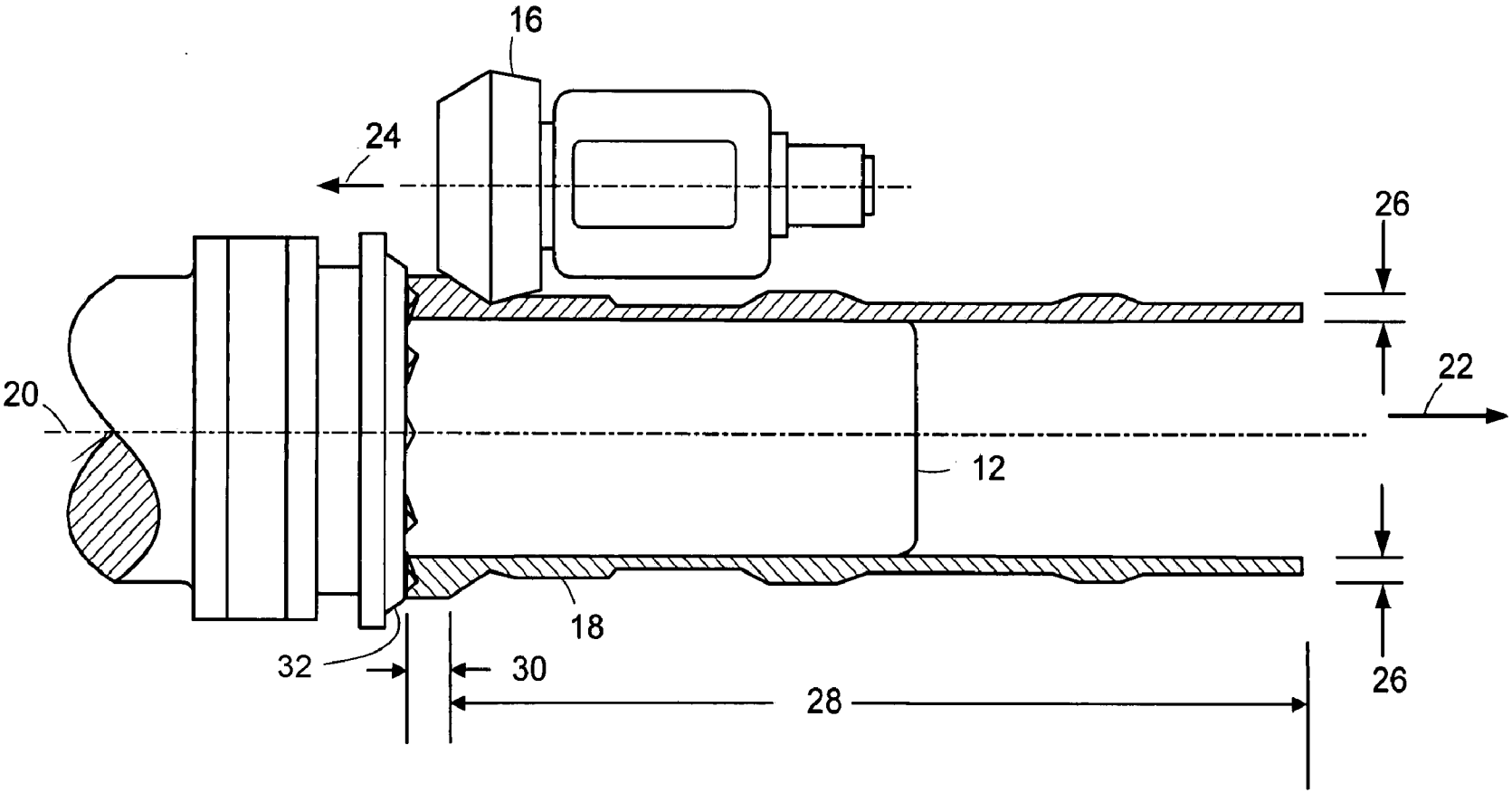
FIG. 3 schematically shows a side-view of a workpiece undergoing a reverse flowforming process.

In reverse flowforming, a flowforming device may be configured in a similar manner to that shown in FIG. 1, but a drive ring 32, rather than the tailstock 14, secures the workpiece 18 to the mandrel 12. As shown in FIG. 1, the drive ring 32 is located near the headstock 34 at the other end of the mandrel 12. FIG. 3 shows a side-view of a workpiece undergoing a reverse flowforming process. During this process, the workpiece 18 may be placed on the mandrel 12 and pushed all the way against the drive ring 32 at one end of the mandrel 12 (to the left side, as shown in FIG. 1). Rollers 16 may be moved into a position of contact with the outer surface of the workpiece 18 at a desired location along its length. The carriage 19 may then move towards the drive ring 32 (in a right to left direction, as shown in FIG. 1) applying a force to the workpiece 18. The force may push the workpiece 18 into the drive ring 32 where it may be entrapped or secured by a series of serrations or other securing means on the face of the drive ring 32. This allows the mandrel 12 and the workpiece 18 to rotate about an axis 20 while rollers 16 may apply one or more forces to the outer surface of the workpiece 18. The material is plastically deformed and moves or flows in direction 23, generally parallel to axis 20. Similar to forward flowforming, rollers 16 may be positioned at any desired distance from the outer diameter of mandrel 12 or the inner wall of workpiece 18, to produce a wall thickness 26 that may be constant or varied along the length of the workpiece 18. Length 28 represents the portion of the workpiece 18 that has undergone the flowforming process whereas length 30 is the portion that has yet to be deformed. As the workpiece 18 is processed, it extends down the length of the mandrel 12 away from drive ring 32. This process is termed "reverse flowforming" because the deformed material flows in the direction 22 opposite to the direction 24 that the rollers are moving.

In embodiments of the present invention, the workpiece 18 may be subjected to one or more flowforming passes with each flowforming pass compressing the walls of the workpiece 18, or some portion thereof, into a desired shape or thickness. The flowforming process cold works the material which usually reduces the grain size of the material and realigns the microstructure, relatively uniformly, in the longitudinal or axial direction parallel to the center line of the flowformed tube. When a material is cold worked, microscopic defects are nucleated throughout the deformed area. As defects accumulate through deformation, it becomes increasingly more difficult for slip, or the movement of defects, to occur. Thus, with the degree of cold work, the hardness and tensile strength of a material are increased while ductility and impact values are lowered. Therefore, if a material is subjected to too much cold work, the hardened, less ductile material may fracture. When the material is plastically deformed and trapped/compressed onto the hard mandrel under the set of rotating rollers, large wall reductions may be realized at one time. For example, cross-sectional wall reductions for most materials may be up to 75-80% of the starting wall thickness. Typically, the workpiece 18 may be flowformed up to four to six times its starting length without the need for an intermediate heat treatment process. In the final flowforming pass, the rollers 16 may be configured in such a way as to cause the inner diameter of the workpiece to be compressed onto the mandrel 12 with sufficient force so that the inner diameter plastically deforms sufficiently enough, imparting a compressive hoop stress to the inner diameter. Embodiments of this autofrettage process will be described in more detail below.

Figure 4:
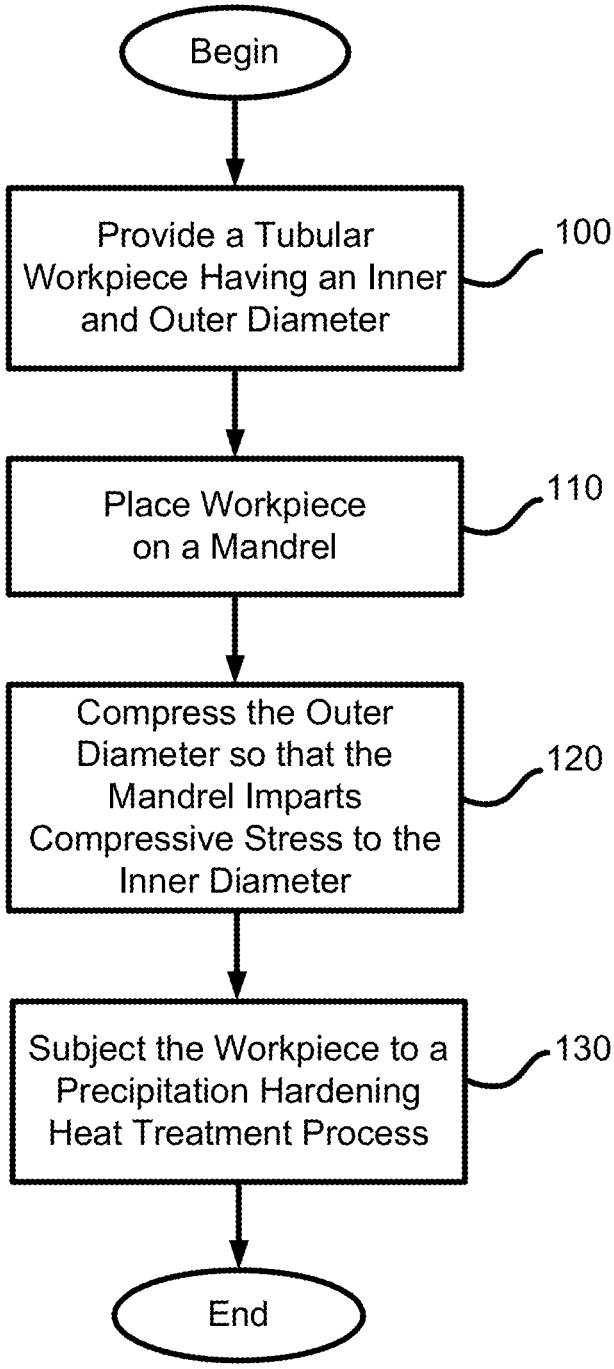
FIG. 4 shows a process of producing a tubular component according to embodiments of the present invention.

FIG. 4 shows a process of producing a tubular component according to embodiments of the present invention. The process begins at step 100, in which a tubular workpiece 18 having an inner and outer diameter is provided. The tubular workpiece may be formed by any known process, e.g., rotary forged, radial forged, rotary swaged, a drilled bar, etc. The tubular workpiece is preferably made of a superalloy material. Superalloys are a class of materials that retain their strength and corrosion resistance at high temperatures, e.g., around 1,200° F. or higher. The superalloy materials may include nickel-based superalloys, cobalt-based superalloys, iron-based superalloys, or a combination thereof. Illustrative examples include Hastelloy (e.g., G-30 material), Inconel (e.g., 718 material), Stellite 21, and L-605 material. The workpiece may also be made of an age hardenable material, such as stainless steel alloys, titanium-based alloys or a combination thereof. Illustrative examples include A28 stainless steel and 316 stainless steel. The tubular workpiece may be monolithic or may include a liner material bonded to the inner diameter of the workpiece. The liner material may be made of one or more of the materials listed above. The above listings of specific alloys, however, are merely intended to be illustrative of suitable materials and not intended to limit the scope of various embodiments.

In step 110, the workpiece 18 is placed onto the mandrel 12 such that the inner diameter of the workpiece is adjacent to the mandrel 12. The workpiece 18 is then subjected to one or more flowforming passes wherein two or more rollers 16 apply a force to the outer surface of the workpiece 18 at a temperature below the recrystallization temperature of the workpiece. Although the remaining discussion will be in the context of using flowforming as the metal forming process, discussion of flowforming is illustrative and not intended to limit the scope of various embodiments. In the final flowforming pass, the rollers 16 may be configured in such a way that the rollers compress the outer diameter of the workpiece using a combination of axial and radial forces so as to cause the inner diameter of the workpiece 18 to be compressed onto the mandrel 12 with sufficient force so that the inner diameter plastically deforms sufficiently enough, imparting a compressive stress to the inner diameter (step 120).

Figure 5:
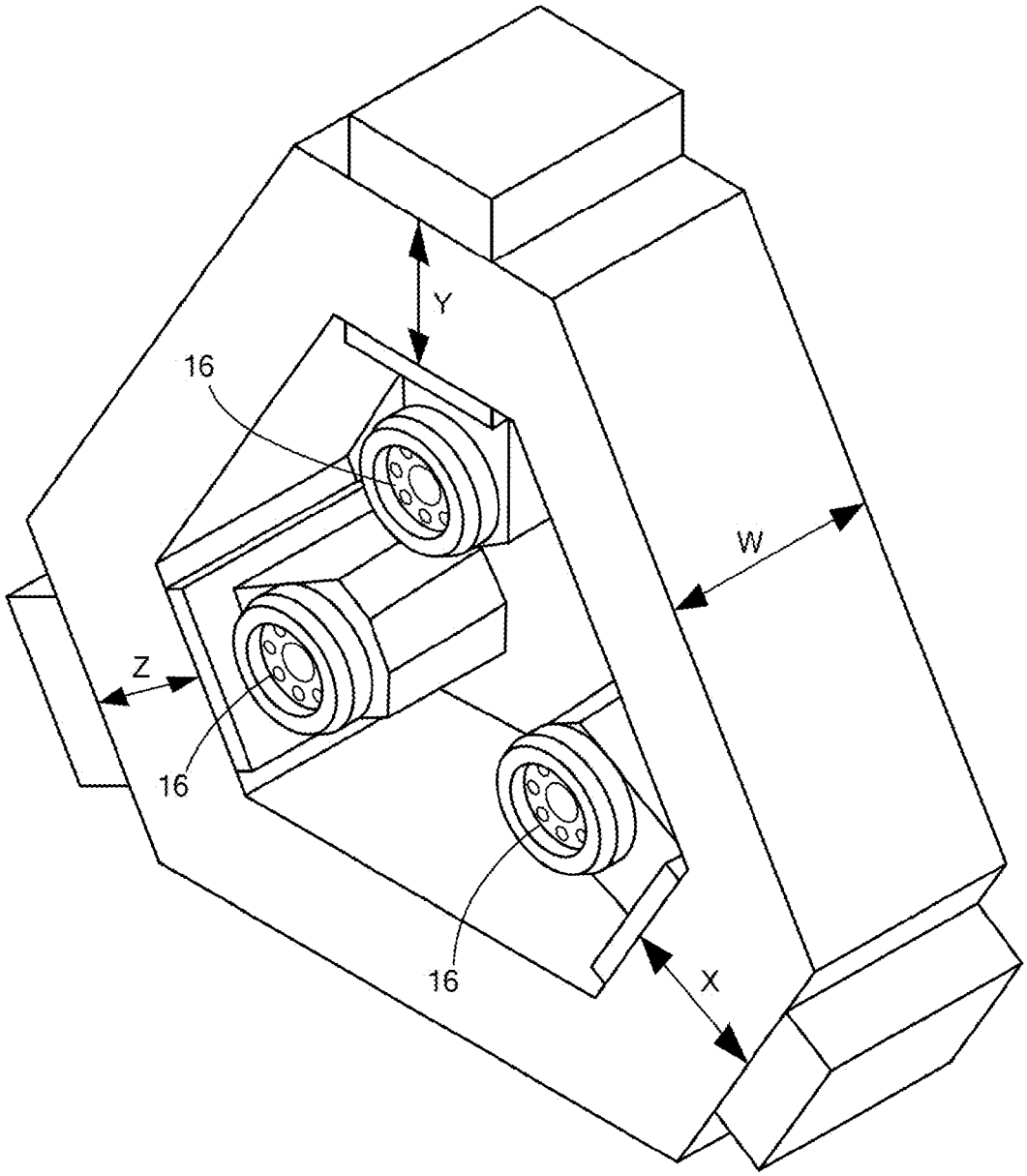
FIG. 5 schematically shows a perspective view of rollers according to embodiments of the present invention.
Figure 6:
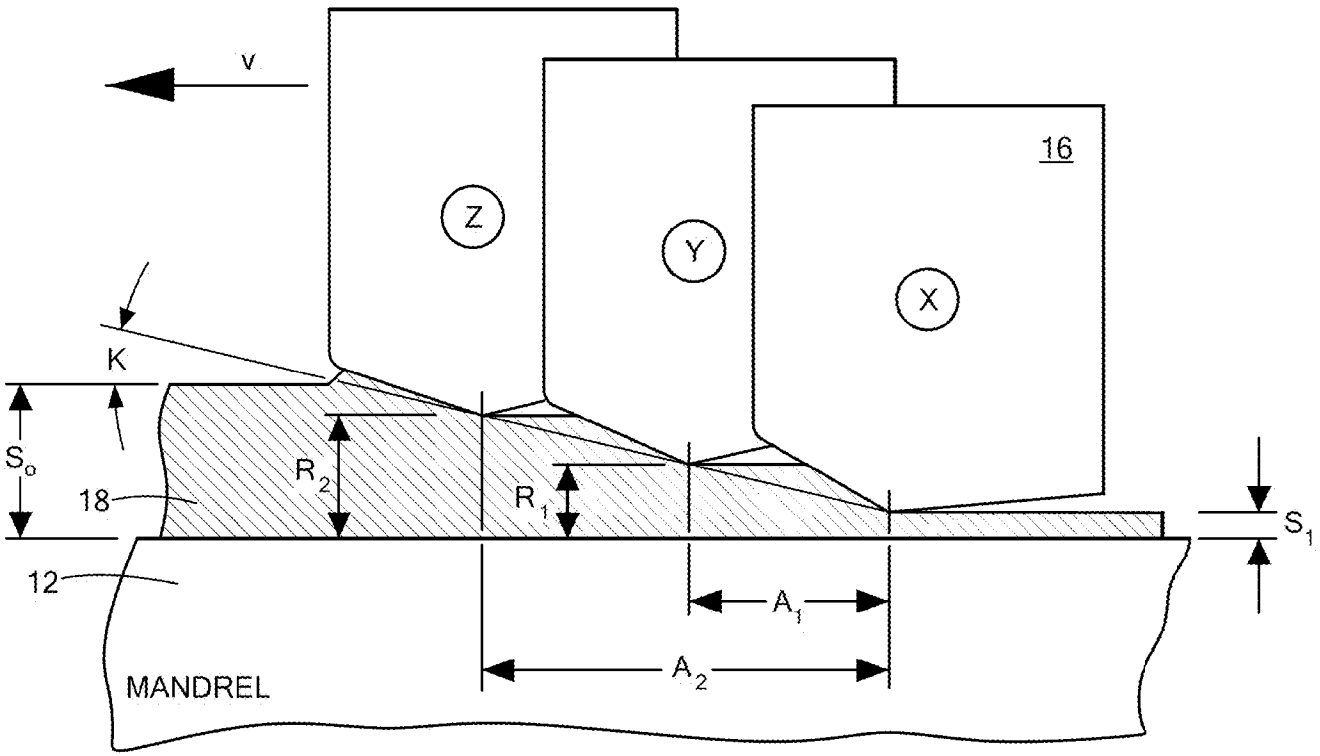
FIG. 6 schematically shows a side-view of a roller configuration with a workpiece undergoing a forward flowforming process according to embodiments of the present invention.

FIGS. 5 and 6 show a perspective view and side view, respectively, of a roller configuration according to embodiments of the present invention. FIG. 5 shows a carriage that houses three flowforming rollers (shown as X, Y and Z in FIG. 6) that may move along three axes (shown as X-, Y- and Z-axes) and which are radially located around the spindle axis, e.g., at 120° apart from one another. Although the figures show three rollers, the process may use two or more rollers. The independently programmable X, Y and Z rollers provide the necessary radial forces, while the right to left programmable feed motion of the W-axis applies the axial force. Each of the rollers may have a specific geometry to support its particular role in the forming process. In addition, the position of the rollers 16 may be staggered with respect to one another. The amount of stagger may be varied and may be based on the initial wall thickness of the workpiece and the amount of wall reduction desired in a given flowforming pass. For example, as shown in FIG. 6, $S_o$ shows the wall thickness of a workpiece before a given flowforming pass and $S_1$ shows its wall thickness after the flowforming process with the rollers 16 moving in the v direction. The rollers 16 may be staggered axially along an axial direction of the workpiece 18 (shown as the W-axis in FIG. 5) and may be staggered radially with respect to the centerline or inner diameter of the workpiece (along the X-, Y- and Z-axes), preferably to apply a relatively uniform compression to the outside of the workpiece 18. For example, as shown in FIG. 6, roller X may be separated from roller Y by a displacement or distance $A_1$ and may be separated from roller Z by a distance $A_2$ along an axial direction of the workpiece 18. Similarly, roller X may be radially displaced from the inner diameter of the workpiece a distance, $S_1$, which is the desired wall thickness of the workpiece 18 after a given flowforming pass, roller Y may be radially displaced a distance, $R_1$, and roller Z may be radially displaced a distance, $R_2$. As shown, an angle K may be used to help determine the amount of radial staggering once an axial staggering amount has been determined.

The more the rollers X, Y and Z are separated from one another the greater the helical twist imparted to the grain structure of the workpiece. If rollers X, Y and Z are pulled sufficiently apart from one another, the flowform process causes the workpiece 18 to compress against and grip the mandrel 12 compared to the workpiece 18 just releasing from or springing back off of the mandrel 12 which is what typically occurs during a standard flowforming process. Causing the inner diameter to compress against the mandrel 12 in this way imparts a compressive hoop stress on the inner diameter of the flowformed component. A lubricant should be used between the inner diameter of the workpiece 18 and the mandrel 12 in order to reduce the problems of the workpiece 18 becoming stuck or jammed onto the mandrel 12 during this process. The compressive hoop stress imparted to the component in this way should arrest any crack that may initiate on the inner diameter of the component, effectively improving its fatigue life. One benefit of this process is that the amount of compressive stress imparted to the inner diameter may be varied along the length of the tube depending on the roller configuration. For example, the rollers may be configured in such a way that a compressive stress is only imparted to one portion of the tube, e.g., on one end or in the middle of the tube.

Figure 7A:
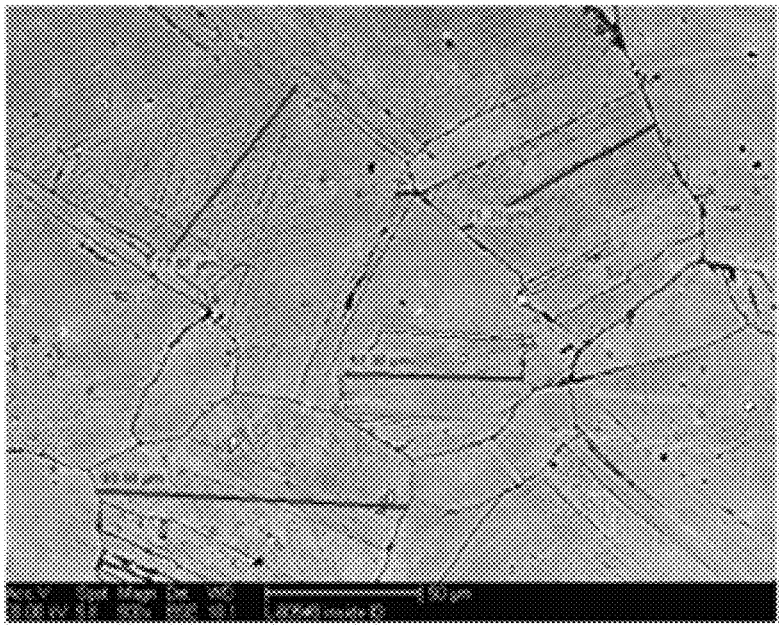
FIGS. 7A-7C are photomicrographs showing longitudinal cross-sectional views of the microstructure in the inside surface, the middle area, and the outside surface, respectively, of a tubular component made of a superalloy material after flowforming with a 20% wall reduction according to embodiments of the present invention.
Figure 7B:
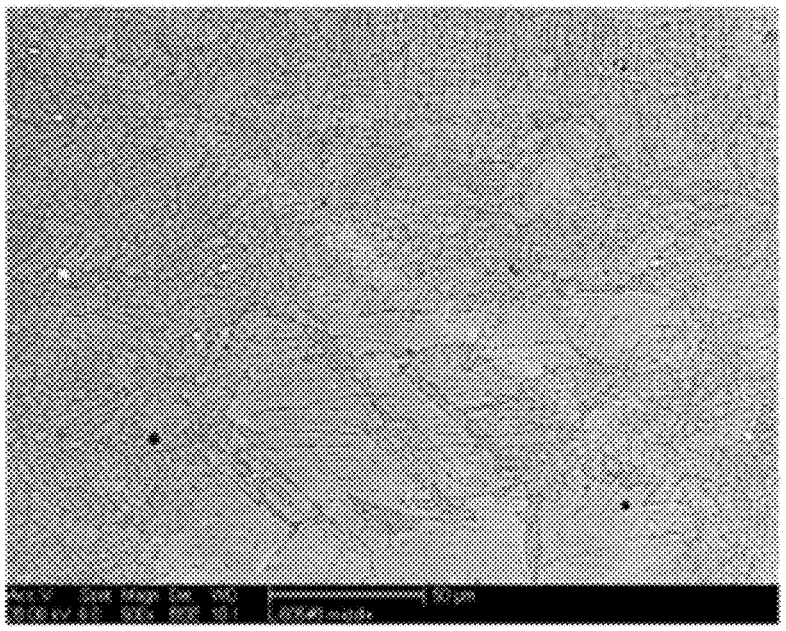
Figure 7C:
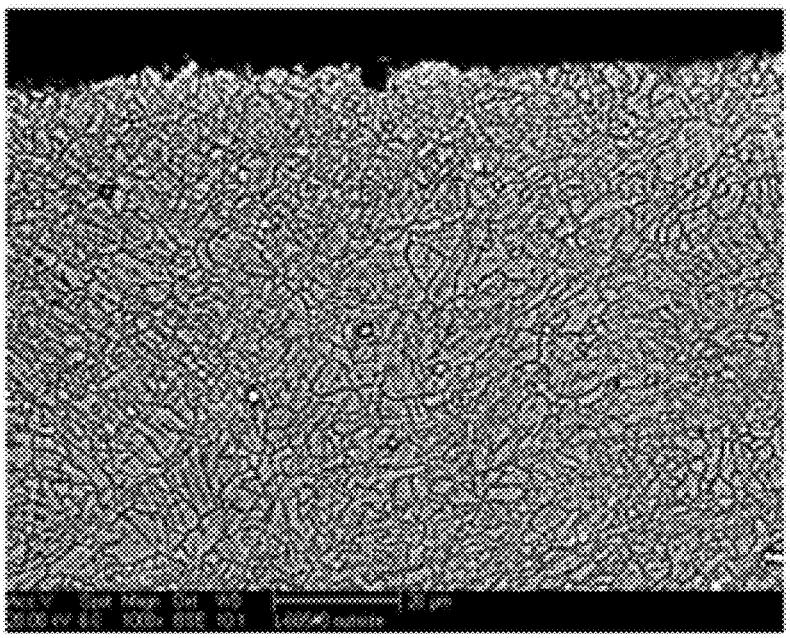

FIGS. 7A-7C are photomicrographs showing longitudinal cross-sectional views of a tubular workpiece made of L-605 material subjected to a flowforming process. The wall thickness of the workpiece was reduced by approximately a 20% wall reduction. The samples were etched in order to show the grain structure. FIGS. 7A and 7B are photomicrographs showing the inside surface and the middle area, respectively, of the flowformed tube at a 500× magnification, and FIG. 7C shows the outer surface of the flowformed tube at a 1000× magnification. As shown, there is a significant difference in the amount of cold work the grain structures have undergone in these three areas. The grain structure is more refined in the outer surface than the middle area, which is more refined than the inner surface. This difference in microstructure shows that the inner surface has undergone less cold work than the outer surface causing a residual stress distribution within the workpiece.

Figure 8:
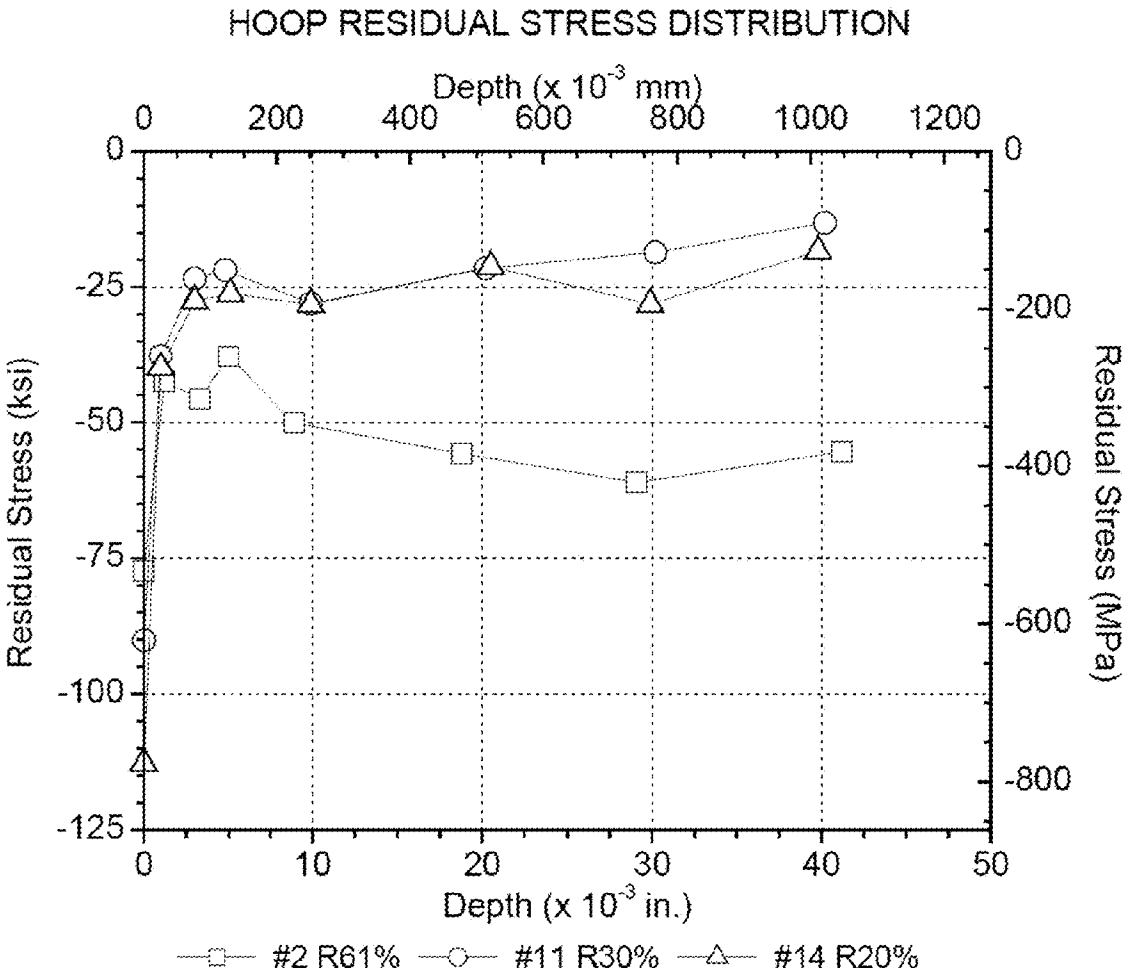
FIG. 8 shows a graph of residual hoop stress distribution for tubular components made of a superalloy material and formed according to embodiments of the present invention.

FIG. 8 shows a graph of the residual hoop stress distribution for tubular components made of a superalloy material. As shown, three tubular workpieces of L-605 material were formed and each workpiece's wall thickness was reduced by approximately 61%, 30% and 20% total wall reduction, respectively, according to embodiments of the present invention. In this case, the three samples had final dimensions of about one inch for the inner diameter and about 0.100-0.150" for the wall thickness. As shown in FIG. 8, each workpiece exhibited a residual compressive stress at its inner surface with a smaller residual compressive stress still seen within the workpiece for the depth measured in the samples. The 20% wall reduction workpiece showed a higher residual hoop stress at the inner surface (e.g., 0 depth from the inner surface) than the 61% wall reduction workpiece, although the higher 61% wall reduction exhibited a larger compressive stress within the workpiece (e.g., about $5\text{-}40\times10^{-3}$ in. depth) than the 30% or 20% workpiece. This higher residual hoop stress at the inner surface for the 20% wall reduction workpiece may be caused by the significant difference in the amount of cold work the grain structures have undergone in the inner surface versus the outer surface, as shown in FIGS. 7A-7C.

Other components of the flowforming system may also be varied depending upon the desired configuration of the finished component. For example, when flowforming a workpiece with a small inner diameter, e.g., 1 inch or less inner diameter, the mandrel diameter needs to be smaller as well. When a smaller diameter mandrel is used, the forces used to compress the outer diameter of the component may need to be reduced in order to reduce the torque and force being transmitted to the mandrel. This may be accomplished in a number of ways. For example, taking two or more flowforming passes is helpful in deforming the material without applying too much force to the smaller inner mandrel, which cannot withstand the rollers applying too much force at a given time. In addition, the diameter of the rollers may also be reduced in order to help reduce the torque and force being transmitted through the rollers and the component. When using smaller diameter rollers, more speed should be used to rotate the mandrel, which in turn causes the rollers to rotate more quickly around the workpiece. The number of rollers used may also be increased. When flowforming a workpiece that has a relatively large wall thickness compared to its inner diameter (e.g., 1:1 ratio or larger) one or more of these parameters (e.g., two or more flowforming passes, smaller rollers, higher speeds, larger number of rollers) may also be used.

In addition, the configuration of the mandrel 12 may also be varied depending on the desired final configuration of the workpiece. For example, the mandrel 12 may have one diameter along its length, or may vary in diameter, in a continuous manner and/or in a stepwise fashion, one or more times along its length. This allows the workpiece to have varying inner diameters and/or varying wall thicknesses along the length of the tube depending on the outer diameter(s) of the workpiece. Stepwise and gradual wall thicknesses may be achieved as many times and in any order as desired along the length of the tube. For example, the muzzle end of a tubular component may be fabricated into a horn-like shape. Such a shape (often known as blast attenuation devices (BAD) in the weapons industry) may be desired to more controllably dissipate projectile propellant gases as a projectile leaves the component, e.g., in a mortar tube. If desired, the mandrel 12 and the flowforming process may be adjusted so that the wall thickness of the workpiece becomes thinner or thicker as its inner diameter is increased or decreased either in a stepwise or continuous manner.

Additionally, the outer surface of the mandrel 12 may be constructed in such a way as to impart rifling, grooves, notches, or other configurations to the inner surface of the workpiece as it is flowformed. This may be accomplished by constructing the mandrel with spiral, straight, periodic, or other desired ridges on its surface. These ridges leave the rifling, grooves, notches and/or other configurations in the inner surface of the workpiece after the final flowforming pass is completed. Alternatively, rifling and/or other configurations may be imparted to the inner surface of the workpiece by, for example, appropriate machining of the inner surface of the workpiece after the flowforming process is completed.

Returning to the process of FIG. 4, the workpiece may be subjected to an optional heat treatment after the flowforming process in step 130. For example, the workpiece may be subjected to a precipitation hardening heat treatment one or more times. As known by those skilled in the art, there are two different heat treatments involving precipitates that can alter the strength of a material, solution heat treating and precipitation heat treating. Solid solution strengthening involves formation of a single-phase solid solution and leaves a material softer, whereas precipitation hardening is used to increase the material's yield strength. Precipitation hardening, also called age hardening or precipitation heat treatment, is a heat treatment process that relies on changes in solid solubility with temperature to produce fine particles of an impurity phase, which impede the movement of dislocations or defects in a crystal's lattice. Since dislocations are often the dominant carriers of plasticity, this process serves to harden the material. Once these particles are formed, then the precipitation hardening process allows the particles to grow at lower temperature. Alloys usually are maintained at elevated temperatures for extended periods of time, e.g., hours, to allow precipitation to take place. Precipitation hardening may produce many different sizes of particles, which may have different properties. Precipitation strengthening, like all heat treatments, is a fairly defined process. If the workpiece is subjected to the heat treatment for too little time (under aging), then the particles may be too small to impede dislocations effectively. If the workpiece is subjected to the heat treatment for too much time (over aging), then the particles become too large and dispersed to interact with the majority of dislocations, and the yield strength of the workpiece begins to decrease.

In embodiments of the present invention, the precipitation hardening process may use a variety of parameters depending upon the material used. For example, Inconel 718 is hardened by the precipitation of secondary phases (e.g. gamma prime and gamma double-prime) into the metal matrix. The precipitation of these nickel-(aluminum, titanium, niobium) phases is induced by heat treating in the temperature range of 1100 to 1500° F. Significantly, the workpiece may be subjected to the precipitation hardening heat treatment without having the workpiece first go through an annealing heat treatment. As known by those skilled in the art, annealing is a heat treatment wherein the material is heated to above its re-crystallization temperature for a suitable time, and then cooled, causing changes in its properties such as strength and hardness. Annealing is typically used to induce ductility, soften material, relieve internal stresses, and refine the structure by making it homogeneous so that the material may undergo further work such as forming and/or further processing, such as precipitation hardening.

As known by those skilled in the art, a material that has been hardened by cold working is typically softened by annealing to relieve the internal stresses imparted during the cold working process. In addition to relieving stresses, annealing may also allow grain growth or restore the original properties of the alloy depending on the temperature and duration of the annealing heat treatment used. When cold working superalloys, in particular, conventional wisdom dictates that the material undergo an annealing heat treatment after being cold worked. For example, many superalloys are used in aerospace applications that require high tensile strength, high fatigue strength, and good stress rupture properties. In Inconel 718, Haynes 25 and 188, for example, the material is typically solution heat treated prior to precipitation hardening to achieve these optimal properties. The high-temperature heat treatment is designed to recrystallize the grain structure and put age-hardenable constituents into solid solution to homogenize the cold worked material before applying an age-hardenable aging heat treatment. This is partly done to remove variations and defects in the material that may detrimentally impact these aging mechanical properties, but also done because of the difficulty in further forming the cold worked material. Annealing and then precipitation hardening (aging) maximizes the strength, fatigue and rupture properties. In embodiments of the present invention, however, an annealing process is not used after the final flowforming pass imparts the compressive stress on the inner diameter of the workpiece, so that the compressive stresses remain. Instead, the precipitation hardening heat treatment strengthens the workpiece without significantly relieving the compressive stresses imparted to the inner diameter during the flowforming process. Another benefit of embodiments of the present invention is that superalloy tubes should not loose this beneficial residual compressive stress when the component is subjected to higher temperatures during operation. For example, a gun barrel made out of conventional steel that has been autofrettaged, typically looses its residual compressive stresses at around 400° C., whereas a gun barrel made from a superalloy material and autofrettaged according to embodiments of the present invention should keep its internal compressive stress up to a much higher temperature, where fatigue failure issues more quickly become a concern.

In embodiments of the present invention, it is important that the workpiece not be subjected to any heat treatments after the flowforming process that will eliminate the beneficial residual compressive stresses on the inner surface. In addition, other processes that may remove or reduce the beneficial residual compressive stresses on the inner surface of the workpiece should also be avoided. For example, mechanical machining of the inner surface of the component, such as honing, and electrical discharge machining (EDM) should be avoided.

Embodiments of the present invention may be used in the manufacture of gun barrels, especially small caliber gun barrels, such as machine gun barrels, or in the manufacture of liners to be used within gun barrels. Small caliber gun barrels currently made of steel wear out before fatigue becomes a problem in the gun barrel. For example, soldiers typically are required to carry several machine gun barrels so that new barrels may be swapped for the old, worn out barrels in the machine guns. Thus, these conventional gun barrels would not overly benefit from a residual compressive stress on the inner surface of the component. However, gun barrels made of superalloy materials should last longer than barrels made from conventional steel since the superalloy materials will be able to withstand higher operating temperatures and more aggressive firing conditions. These superalloy gun barrels should benefit from a residual compressive stress on the inner surface of the component since these gun barrels may fail, at least in part, due to fatigue failure rather than conventional gun barrels that fail due to wear and erosion.

Embodiments of the present invention recognize the benefit of using superalloy materials, without any subsequent annealing, after the cold worked flowforming process in order to impart compressive stresses on the inner surface of the workpiece. However, as mentioned above, certain embodiments of the present invention may include metal forming processes other than flowforming, such as pilgering, rotary forging, radial forging and/or radial swaging. Although those skilled in the art recognize that these are different metal forming processes that produce different cold working results in the workpiece, embodiments may still benefit from using superalloy materials, without any subsequent annealing, after these metal forming processes in order to impart compressive stresses on the inner surface of the workpiece.

As known by those skilled in the art, in the pilgering process, the tubular component is rotated and reduced by forging and elongating the tube stepwise over a stationary tapered mandrel reducing the tube. Two rolls or dies, each with a tapering semi circular groove running along the circumference engage the tube from above and below and rock back and forth over the tube (the pass length) while a stationary tapering mandrel is held in the center of the finished tube. At the beginning of a stroke or pass, the circular section formed between the grooves of the two opposing rolls corresponds to the diameter of the tube and to the thickest section of the mandrel. As the dies move forward over the tube, the circular section reduces in area until, at the end of the pass length, the circular section corresponds to the outer diameter of the finished tube and the inner mandrel diameter corresponds to the inner diameter of the finished tube, resulting in a longer length, smaller outer and inner diameter finished tube. As known by those skilled in the art, a rotary forge process may include two dies that deform a small portion of the workpiece at a time in a continuous manner. In rotary forging, the axis of the upper die is tilted at a slight angle with respect to the axis of the lower die, causing the forging force to be applied to only a small area of the workpiece. As known by those skilled in the art, a radial forge process may include four hammers moving in and out and hammering the workpiece over a mandrel. The driver and counter holder move the workpiece over the mandrel and into the reciprocating hammers. As known by those skilled in the art, a rotary swage process may include dies that rotate as a group inside of a stationary housing as the workpiece is pushed over the mandrel and into the dies which upsets/swages the material. It is anticipated that staggering the rollers, dies, and/or hammers used in these metal forming processes, such as discussed above with respect to the flowforming process, may provide similar beneficial compressive stress results on the inner diameter of the workpiece.

Although the above discussion discloses various exemplary embodiments of the invention, it should be apparent that those skilled in the art can make various modifications that will achieve some of the advantages of the invention without departing from the true scope of the invention.

What is claimed is:

1. A method of producing autofrettage in a tubular component, the method comprising:

providing a tubular workpiece having an inner diameter and an outer diameter, wherein the workpiece includes at least one of a nickel-based superalloy, a cobalt-based superalloy, and an iron-based superalloy;

providing at least two rollers having a displacement from one another in an axial direction with respect to the workpiece;

placing the workpiece on a mandrel such that the inner diameter is adjacent to the mandrel; and compressing the outer diameter of the workpiece with the rollers at a temperature below a recrystallization temperature of the workpiece using a combination of axial and radial forces so that the mandrel contacts the inner diameter and imparts a compressive hoop stress of at least 500 MPa to the inner diameter of the workpiece.

2. The method of claim 1, further comprising subjecting the workpiece to a precipitation hardening heat treatment after compressing the workpiece.

3. The method of claim 1, wherein the tubular workpiece is produced by rotary forging, radial forging, rotary swaging, or a combination thereof.

4. The method of claim 1, wherein the mandrel further imparts a rifling to the inner diameter of the workpiece.

5. A tubular component produced according to the method of claim 1.

6. A method of producing a superalloy tubular component, the method comprising:

providing a tubular workpiece having an inner diameter and an outer diameter, the workpiece made of a superalloy material comprising at least one of a nickel-based superalloy, a cobalt-based superalloy, and an iron-based superalloy;

placing the workpiece on a mandrel such that the inner diameter is adjacent to the mandrel; and compressing the outer diameter of the workpiece at a temperature below a recrystallization temperature of the workpiece using a combination of axial and radial forces so that the mandrel contacts the inner diameter and imparts a compressive hoop stress of at least 500 MPa to the inner diameter of the workpiece.

7. The method of claim 6, further comprising subjecting the workpiece to a precipitation hardening heat treatment after compressing the workpiece.

8. The method of claim 6, wherein the tubular workpiece is produced by rotary forging, radial forging, rotary swaging, or a combination thereof.

9. The method of claim 6, wherein the mandrel further imparts a rifling to the inner diameter of the workpiece.

10. A tubular component produced according to the method of claim 6.

11. A method of producing a superalloy gun barrel, the method comprising:

providing a tubular workpiece having an inner diameter and an outer diameter, wherein the inner diameter is about one inch or less and the workpiece is made of a superalloy material comprising at least one of a nickel-based superalloy, a cobalt-based superalloy, and an iron-based superalloy;

placing the workpiece on a mandrel such that the inner diameter is adjacent to the mandrel; and compressing the outer diameter of the workpiece at a temperature below a recrystallization temperature of the workpiece using a combination of axial and radial forces so that the mandrel contacts the inner diameter and imparts a compressive hoop stress of at least 500 MPa to the inner diameter of the workpiece.

12. The method of claim 11, further comprising subjecting the workpiece to a precipitation hardening heat treatment after compressing the workpiece.

13. The method of claim 11, wherein the tubular workpiece is produced by rotary forging, radial forging, rotary swaging, or a combination thereof.

14. The method of claim 11, wherein the mandrel further imparts a rifling to the inner diameter of the workpiece.

15. The method of claim 11, wherein compressing the outer diameter is done by a flowforming process, a rotary forging process, a rotary swaging process, or a combination thereof.

16. A superalloy gun barrel produced according to the method of claim 11.

17. A superalloy liner produced according to the method of claim 11, the liner to be used within an inner diameter of a gun barrel.

* * * * *